United States Patent [19]

Hohn

[11] 4,454,181

[45] Jun. 12, 1984

[54] RESILIENTLY DEFORMABLE SAFETY COVERING TILE

[75] Inventor: Werner Hohn, Weimar, Fed. Rep. of Germany

[73] Assignee: Wegu Gummi-U. Kunststoffwerke Walter Drabing KG, Kassel, Fed. Rep. of Germany

[21] Appl. No.: 466,790

[22] Filed: Feb. 16, 1983

[30] Foreign Application Priority Data

Aug. 26, 1982 [DE] Fed. Rep. of Germany ..... 3231779

[51] Int. Cl.[3] ..... B32B 3/02; B32B 3/30

[52] U.S. Cl. ..... 428/68; 52/309.13; 52/309.17; 52/588; 428/81; 428/99; 428/156; 428/167; 428/192

[58] Field of Search ..... 428/45, 81, 99, 17, 428/156, 167, 192; 52/309.13, 309.17, 588

[56] References Cited

U.S. PATENT DOCUMENTS 4,287,693 9/1981 Collette ..... 428/81

FOREIGN PATENT DOCUMENTS 1229516 4/1971 United Kingdom .

*Primary Examiner*—Paul J. Thibodeau

*Attorney, Agent, or Firm*—George M. Thomas

[57] ABSTRACT

Resiliently deformable safety covering tiles have a base 2 made of rigid material such as concrete, and a cover body 3 provided on the top side of the base made of resiliently deformable material such as rubber. These safety covering tiles should be easy to lay while exhibiting no corrugation or bulging on their top side 5 during changes in temperature. To achieve this, on a continuous edge portion 10 of a covering tile portion 4 of the cover 3, at the height of a ledge 15 of the base 2, one or more lateral projections 18 are distributed over the periphery of the cover. The continuous edge portion 10 has a gap-forming reduced portion 19 at the height of spacers 7 and of the covering tile 4 and has at the height of the spacers 7 a reduced cross-section 22 which permits lateral movements.

4 Claims, 3 Drawing Figures

7
6
5
9
8
1
3
4
7
15
10
19
20
22
17
21
18
14
2
13
16
11
12

5
1
23
3
23
10

1
25
26
25
3
5
24
10
24

RESILIENTLY DEFORMABLE SAFETY COVERING TILE

BACKGROUND OF INVENTION

This invention relates to a resiliently deformable safety covering tile, especially for floors, having a rigid base and a cover made of resiliently deformable material which includes a covering tile that is retained at a distance from the base and which possesses, on its underside only, a plurality of knob-like spacers which, being distributed essentially uniformly, rest loosely on the surface of the base. The covering tile has a continuous edge with a reentrantly directed bend by means of which it is anchored to the base. The base has a continuously stepped border formed with a continuous recess located on the side facing away from the covering tile, and the continuous edge of the covering tile, located outside the outline of the base, engages by means of its bend into the cutout portion of the base with a free space being provided under the bend of the continuous edge of the covering tile. Such safety covering tiles are used as ready-to-assemble floor parts preferably for small playing fields, as fall-protection floors in childrens' playgrounds and under games and sports equipment, and also in other leisure establishments. They can be laid on any foundation, for example in a sand bed, and also on a rough concrete floor or the like, with insulating material being interposed.

The invention evolves from a safety covering tile as is described in an as yet unpublished German application Serial No. P 31 06 784.0-25 of the present applicant. Here, a safety covering tile is provided in which a uniform force reduction is achieved over the entire tile and above and beyond its limits in a composite structure. The safety covering tile has the same or at least approximately the same deformability in all its regions. There is no anchoring of any kind between the inside of the covering tile or spacers and the surface of a base. Anchoring is maintained, on the one hand, by means of a continuous edge and a reentrantly directed bend on a stepped border, and knob-like spacers clearly separated in functional terms. In this way, anchoring no longer impedes the resiliently deformability of the covering tile. The continuous edge of the cover possesses, facing the particular tile adjacent to it, a vertically limiting face which extends from the region of spacers over much of the height of the base, so that when these safety covering tiles are laid in a composite structure these vertical faces of the individual tiles come to rest against one another. Because of the movability of the covers in relation to the bases, an undesirable corrugation of the surfaces of the covering tiles takes place during temperature changes as a result of different coefficients of expansion of the cover, on the one hand, and of the base, on the other hand. Especially when there is strong solar radiation on safety covering tiles laid closely up against one another in a composite structure, bulge-like arching of the individual covers is observed with the result that the entire surface becomes uneven.

Relevant safety covering tiles are also known from Great Britain Patent Specification No. 1,229,516 and from German Patent Specification No. 2,329,542. There, the existing covering tile portion of the cover is connected via anchoring bodies being arranged at intervals between the spacers and being anchored in the hardened material of the base. Moreover, these known safety covering tiles possess a continuous edge which rests on the top side of the base and thus forms an edge support. In these known safety covering tiles, the vertical side face of each tile is made continuous on the cover and on the base. When, as is customary, these tiles are laid without play in a composite structure, a temperature change results in comparatively pronounced corrugation and bulging, because, in addition, the air cushion retained between the cover and base is held sealed off by the edge resting on the base.

German Utility Model No. 70 13 835 shows a covering tile in which the cover is connected to the base via undercut portions. Here, there is no air cushion between the cover and the base, but the anchoring points and the continuous edge provided with a bend are anchored in the hardened material of the base. Here also, the tiles are limited on the four sides by vertically continuous faces. German Utility Model No. 76 09 345 shows a floor tile of similar design, but in this the covering tile is widened continuously round the side by means of shaped-on edge strips which serve the purpose of stamping the cover accurately to size after it has been produced, or of trimming the edge strips according to the dimensional accuracy required. Here too, the anchoring members and the continuous edge are shaped into the material of the base during the hardening of the latter. German Utility Model No. 77 24 504 shows a further development inasmuch as there are, here, on the underside of the covering tile spacers between which an air cushion can form. Here also, the continuous edge provided with the bend is anchored positively in the material of the base. The cover has, at the height of the covering tile, a continuous edge widening which projects in relation to the otherwise vertical limiting face. Such a design impedes the laying of the tiles in a composite structure inasmuch as the tiles with these edge widenings have to be laid up against one another so that the tiles have a plane surface at least at the laying temperature. However, even here there is a danger that the covers will exhibit the corrugation and bulging already described, especially in the case of strong solar radiation, because they are supported against one another in the region of the covering tile, and since the bend of the edge is shaped, the air cushion is also additionally enclosed and sealed off, and this expands accordingly under the effect of heat.

The corrugation and bulging described can be counteracted, in all events for covering tile of the type described in the introduction, by laying the individual tiles at a distance from one another, that is to say ensuring a continuous gap. Considerable care must be exercised to make these gaps uniform. Accessory devices, such as gap spacers, may be necessary here. In spite of these measures, which make the laying work more difficult, it may happen during the use of the floor covering that individual tiles change their relative positions in relation to the adjacent tiles and thereby butt against one another in the region of the gap so that corrugation and bulging can arise even here, though to a lesser extent.

An object of the invention is to provide safety covering tiles in which, on the one hand, can be laid easily and without additional aids and in which, on the other hand, corrugation and bulging are eliminated so that temperature effects do not cause a change in shape of the free surface of the tile covers.

DESCRIPTION OF THE INVENTION

This is achieved, according to the invention by the fact that on the continuous edge of the tile cover, at the height of a step of the base, one or more projections are distributed over the periphery of the cover so that the continuous edge has a gap-forming cut-out portion at the height of the spacers and of the covering tile so that the continuous edge has, at the height of the spacers, a reduced cross-section permitting lateral movements. A double function is achieved by means of this design. The safety covering tiles are supported directly against one another so that they are comparatively simple to lay. The tiles can be laid so as to butt directly against one another. Spacers or similar aids are not needed during laying. Nevertheless, this support does not impede the expansion of the covering tile during temperature changes. The mutual support of the tiles against one another is at a considerable distance from the surface of the covering tile. In conjunction with this, the cross-section of the edge is provided, at the height of the transition point between the base and the spacers of the cover, with, as it were, a weak point which allows the cover to bend away laterally or spin up or spring together in the plane of the covering tile, specifically without the freely visible surface of the covering tile being thereby deformed out of its plane as a bulge or corrugation. There consequently forms between the individual covers, at the height of the covering tile and at least essentially over the height of the spacers, a gap which not only has a decorative appearance, but also allows the above-described technical effect of the expansion of the cover in this region during an increase in temperature. A further advantage of this design according to the invention is that the weak point in the region of the continuous edge also makes it easier and simpler to snap the cover onto the base after the latter has hardened and, if appropriate, immediately before laying on site.

The projection can be intended to extend continuously round the continuous edge with half the gap width so that the projection has the same appearance on all four lateral limiting faces. The two projections of any two adjacent safety covering tiles thus form the gap. The advantage of this design is that individual tiles can be laid against one another in any relative position, that is to say with altogether four possibilities in the case of a square design. However, it is also possible for several projections with the full gap width to be arranged distributed over the periphery and so as to complement one another. This advantageously provides a certain intermeshing in the region of the projections. However, it is necessary, in this case, to lay each tile against another in line with this, and there is only one possibility of connection.

It is not necessary in all cases for the projection or projections to extend continuously over the periphery without interruption. On the contrary, it is possible for the projections to have perforations which adjoin the free space through which a more rapid elimination of water takes place and through which the air cushion under the spacers is also communicated to the atmosphere.

It is necessary that in all cases the projections be provided at the height of the step of the base. Although the projection or projections are intended to extend into the region of the bend, this does not obstruct, but, on the contrary, assists removal of the covers from the mold since they can be removed more easily.

A thin space can be provided between the continuous step of the base and the part of the edge of the cover which carries the projections. This is a narrow space, to allow for play during manufacture. This play serves to make it easier to snap the covers onto the bases, on the one hand, and to communicate the air cushion under the covering tile to the atmosphere, specifically via the free space and, if appropriate, the perforations in the region of the projections.

BRIEF DESCRIPTION OF THE DRAWINGS

Exemplary embodiments of the invention are illustrated in the drawings and described in more detail below where.

DESCRIPTION OF THE PREFERRED EMBODIMENTS

Figures 1, 2, 3:
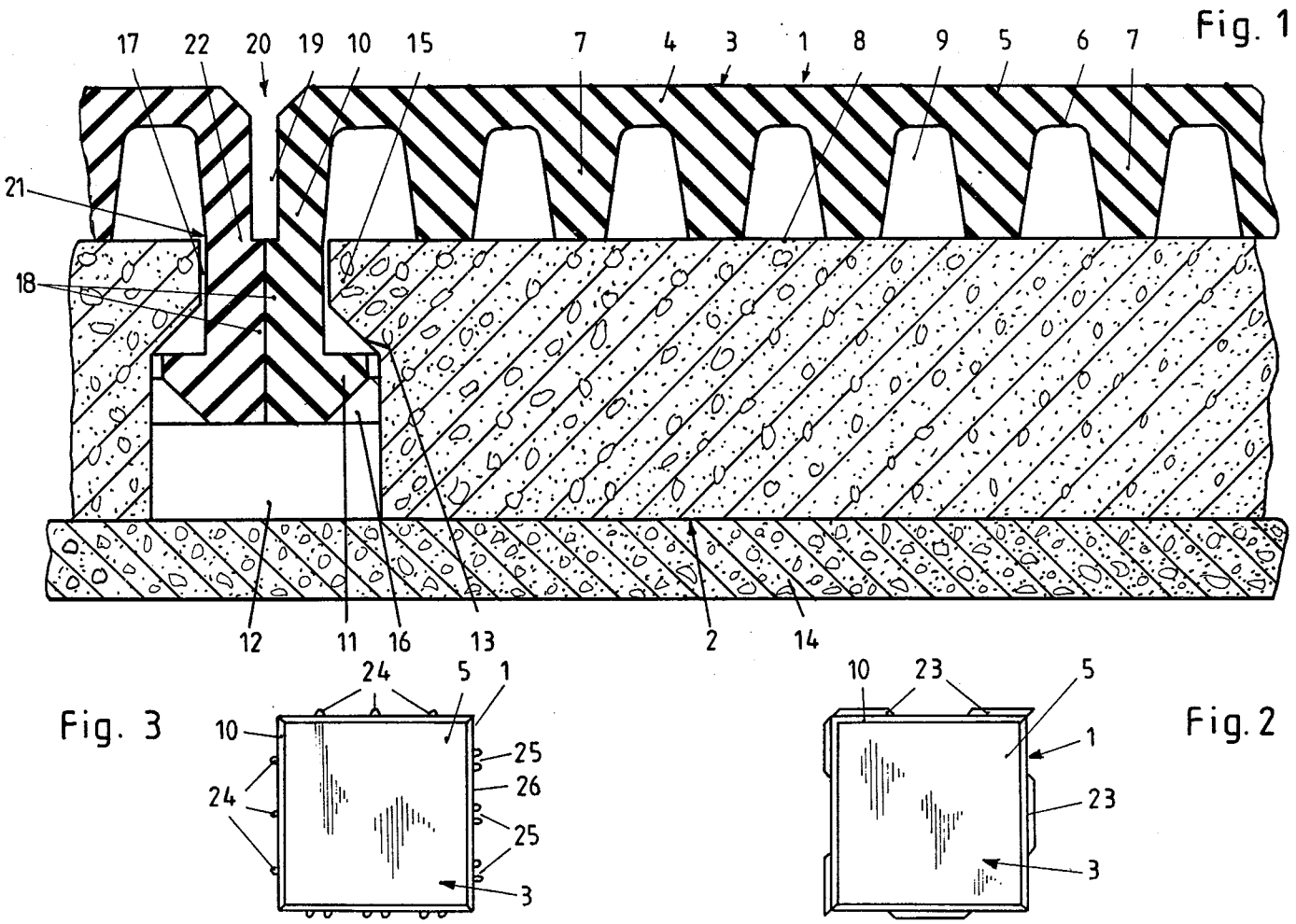
FIG. 1 shows a vertical section taken through parts of two adjacent safety covering tiles laid in a composite structure.
FIG. 2 shows a plan view of the covering body in a reduced representation, with a second embodiment of the projections.
FIG. 3 shows a similar representation to that of FIG. 2 with a further design possibility for the projections.

Each safety covering tile 1 consists essentially of two parts, namely a base 2 and a cover 3 in each case. The bases 2 can be of concrete, wood, plastic or the like, while the covers 3 are, as a rule, made of rubber. Each cover 3 has a covering tile 4 which provides a useful surface on its top side 5 while on its underside 6 there are in a multiplicity and in a regular arrangement, knob-shaped spacers 7 which appropriately taper conically for reasons of mold-removal, and rest loosely on the surface 8 of the base 2. In this way the covering tile 4 is held at a distance from the surface 8 of the base 2, thus forming between the spacers 7 an air cushion 9 which, as also stated later, is communicated to the atmosphere. The height, design and arrangement of the spacers 7 are co-ordinated with or adjusted to the desired spring and force removal properties of the safety covering tile 1. The spacers 7 extend in a regular arrangement over the entire underside of the covering tile 4.

There adjoins the covering tile 4, that is to say at a distance from the base 2, a continuous peripheral edge portion 10 which extends essentially vertically and which is provided outside the outline of the base 2. This edge 10 extends not only to the surface 8 of the base 2, which it does not contact, but also further downwardly over part of the height of the cover 3. There is at its lower end a bend 11 which is directed reentrantly towards the base 2. A free space 12 is formed or located underneath the bend 11 or in the region of a stepped peripheral surface of a ledge 15 of the base 2. The surface 13 extends from the surface 8 up to a rough concrete floor or the surface 14. Adjoining the surface 8 the surface 13 first has a ledge 15 which extends back obliquely at approximately 45°, so that the base here forms a recess 16. This recess 16 merges into the free space 12. The 45° slope of the surface 13 serves to make it easier to remove from a mold the base 2 which is made, as a rule, of concrete. Between the ledge portion 15 and the inside of the edge 10 there can be a narrow space 17 which provides for positive play for production reasons. The continuous edge 10 has a projection 18 projecting outwards at least in the region or at the height of the step 15 of the surface 13 of the base 2. This projection 18 extends down into the region of the bend 11 and is intended to extend continuously round on all four sides of a safety covering tile 1 forming, for example, a square outline. Above the projection 18, the edge 10 has a continuous cut-out portion 19. The two cut-out portions of two adjacent safety covering tiles 1 form together and according to the projections 18 a gap 20 which covers essentially the height of the covering tile 4 and of the spacers 7. As a result of this special cross-sectional shape of the edge 10, the latter has a weak point 21 of reduced cross-section 22, so that during temperature changes the covering tile 4 can expand or retract, while permitting at the same time, movement round the weak point 21 so that, in all events, the top side 5 of the covering tile 4 always remains horizontal, and corrugation or bulging is avoided.

FIG. 2 shows a modification of the cover 3 inasmuch as several projections 23 are provided here, distributed over the periphery of the safety covering tile 1, instead of a single continuous projection 18. The projections 23 complement one another when the safety covering tiles 1 are laid in a composite structure. Here, the projections 23 define the entire width of the gap 20. The safety covering tiles 1 have to be laid against one another oriented directionally, here, although as a result of the sloping projections 23 a certain self-centering effect occurs during laying. As a result, not only is the laying operation itself simplified and assisted, but also lateral drifting of the covers 3 is prevented. The design of the projection 18 according to FIG. 1, or of the projections 23 according to FIG. 2, can be made continuous. However, it is also possible to provide perforations so as to achieve, on the one hand, a flow-off of water from above and, on the other hand, direct communication of the air cushion 9 to the atmosphere.

This is put into effect in the embodiment according to FIG. 3. There, projections 24 and 25 are positioned spaced from one another and relative to one another, and a projection 24 always engages between two projections 25 in the composite structure. Consequently, perforations 26 remain free between the projections 24 and 25, respectively.

In all the embodiments, the projection 18 or the projections 23 or 24 and 25 are, in all events, arranged so that they are located at the height of the step 15, but the space above this is kept free by means of a cut-out portion 19, thus forming the gap 20.

What is claimed is:

1. A resiliently deformable safety covering tile comprising a rigid base having a top surface, a bottom surface and a peripheral ledge, and a resiliently deformable cover that has an upper tile portion from which a plurality of spacers extend downwardly into contact with said base top surface and a peripheral edge portion that depends from said upper tile portion downwardly beside said base ledge to terminate at a position above said base bottom surface, and with said cover peripheral edge portion having an area of reduced cross-sectional thickness adjacent said base top forming a gap between an adjacent cover and thereby permit lateral movement of the cover with respect to an adjacent cover, a reentrant bend portion located beneath said base ledge in spaced relation with base to anchor said cover to said base while permitting air flow from between said cover spacers to a cavity located beneath said cover peripheral edge portion, and an outwardly extending projection located beneath said area of reduced cross-sectional thickness adapted to be placed flush against the same projection of an adjacent tile of the same construction.

2. A safety covering tile in accordance with claim 1 wherein said cover peripheral edge portion extends continuously about the cover periphery.

3. A safety covering tile in accordance with claim 1 wherein said cover peripheral edge portion has a plurality of outwardly extending projections arranged to interlock with the same projection of adjacent tiles of the same construction.

4. A safety covering tile in accordance with claim 1 wherein said cover peripheral edge portion extends beside said base ledge in spaced relationship therewith.

* * * * *